US007195133B1

(12) United States Patent
Cundiff et al.

(10) Patent No.: US 7,195,133 B1
(45) Date of Patent: Mar. 27, 2007

(54) COMPOSITE PRESSURE TANK AND PROCESS FOR ITS MANUFACTURE

(75) Inventors: Roy S. Cundiff, Long Beach, CA (US); Anthony Mancuso, Los Angeles, CA (US)

(73) Assignee: Microcosm, Inc., El Segundo, CA (US)

( * ) Notice: Subject to any disclaimer, the term of this patent is extended or adjusted under 35 U.S.C. 154(b) by 621 days.

(21) Appl. No.: 10/121,737

(22) Filed: Apr. 12, 2002

(51) Int. Cl.
*B65D 25/14* (2006.01)

(52) U.S. Cl. ..... 220/589

(58) Field of Classification Search ..... 220/589, 220/590, 591, 647, 648, 649
See application file for complete search history.

(56) References Cited

U.S. PATENT DOCUMENTS 4,004,706 A * 1/1977 Guldenfels et al. ..... 220/586
5,383,566 A * 1/1995 Johnson ..... 220/562
5,469,985 A * 11/1995 Furuichi et al. ..... 220/632
5,476,189 A * 12/1995 Duvall et al. ..... 220/590
2003/0021628 A1* 1/2003 Gudaitis et al.

* cited by examiner

*Primary Examiner*—Stephen Castellano
(74) *Attorney, Agent, or Firm*—Gates & Cooper LLP

(57) ABSTRACT

A pressure vessel (10) and a process for its fabrication, the vessel (10) having a liner shell (16) formed from composite materials cured out-of-autoclave, and an outer structure (18) formed by winding or laying up additional layers of composite material over the liner shell. The liner shell (16) is formed as two halves, each with an opening into which a boss fitting (20) is installed. The two halves may be separately formed by a lay-up process, or first formed as a whole liner shell by filament winding, the whole liner shell then being cut in half to permit installation of the boss fittings (20). After curing, the halves are assembled and the outer structure (18) is wrapped over the liner shell (16) and also cured out-of-autoclave. The resulting pressure vessel (10) can be used for reliable storage of cryogenic or other materials, yet is light in weight and not costly.

10 Claims, 17 Drawing Sheets

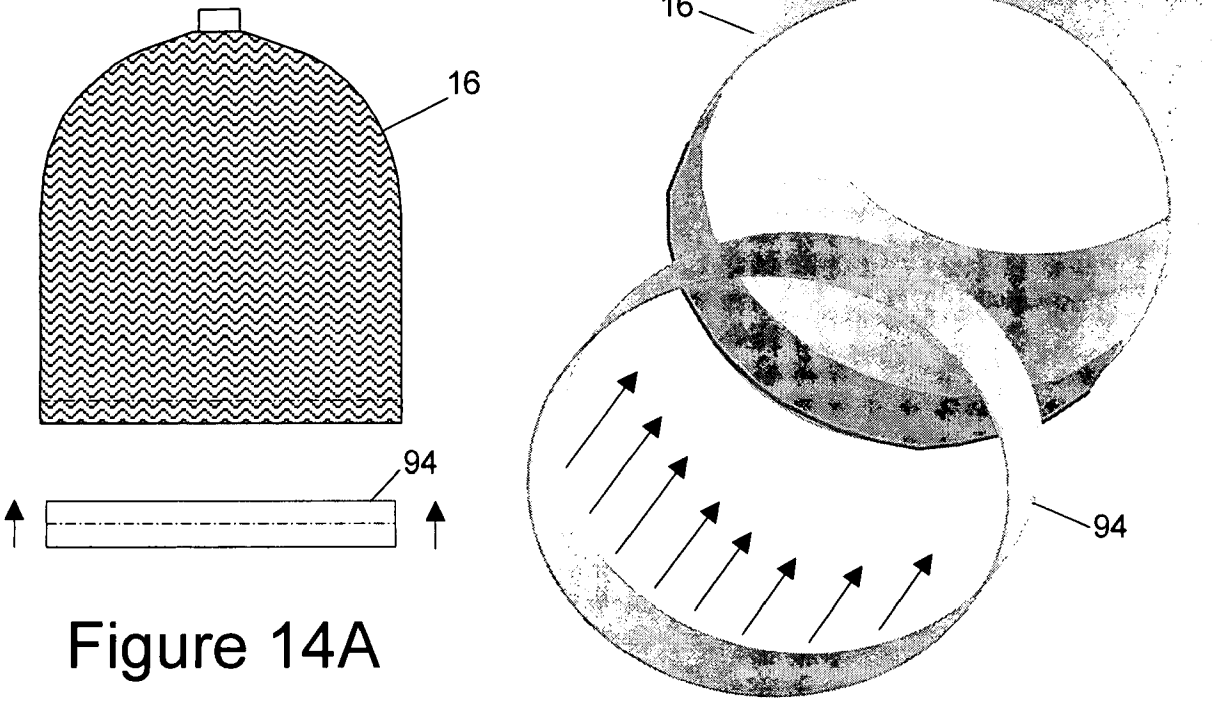
Figure 14A
Figure 14B
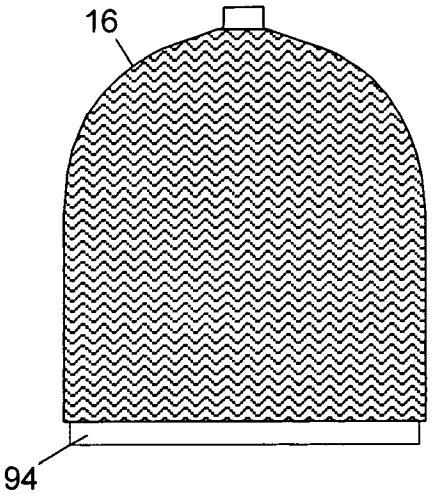
Figure 14C

COMPOSITE PRESSURE TANK AND PROCESS FOR ITS MANUFACTURE

This invention was made with Government support under Contract Number F29601-01C-0069 awarded by the United States Air Force. The Government has certain rights in the invention.

BACKGROUND OF THE INVENTION

This invention relates generally to pressure vessels and, more particularly, to pressure vessels used for storage of cryogenic and other materials in rocket launch vehicles and space applications. In aerospace applications, pressurized propellant tanks may be fabricated by filament winding fiber reinforcement over a thin walled metallic liner. Carbon or fiberglass fibers provide the required strength without the weight penalty associated with an all-metallic tank. Unfortunately, composite pressure vessels with metallic liners present a thermal stress problem, when used to store cryogenic materials. Specifically, significant differences in the coefficients of thermal expansion (CTE), between the metallic liner and the composite outer shell, result in high thermal stresses at the interface. These thermal stresses can be significant enough to cause rupture of the vessel if not addressed. A vessel fabricated with only composite materials would obviate the disadvantages of using a metallic liner. In lieu of a metallic liner, a composite shell can be used and reinforcement fiber wound over it.

There are basically two techniques for a fabricating a composite shell to filament wind over, (1) hand layup and (2) filament winding. In the hand layup process, sections of the material in the form of fabric are laid over a tool (or pattern) that defines the internal surface of the vessel or sections of the vessel. The fabric, for example, may be fiberglass or graphite fabric. The resulting composite (or laminate) consists of layers of fabric impregnated with a matrix binder, such as an epoxy resin. The resin is applied wet and is cured to a hard shell.

After curing, the tool must be removed, which requires that the part of the vessel so formed must have an open end through which the tool may be withdrawn or the tool can be fabricated from a material such as eutectic salt which can be dissolved. The simplest and most direct approach for removing the tooling is to fabricate the composite shell in two halves, which are later joined together with a splice (or "bellyband") of similar composite material.

The filament winding technique for fabricating a composite shell is similar, except the material takes the form of continuous bands of fiberglass or graphite fibers, either previously impregnated with a matrix material or impregnated during winding. The fibers are filament wound over a rotating and removable form. For the filament winding process, the vessel is prepared as a whole vessel, which must be cut in two to remove the tool.

Composite pressure vessels for aerospace applications can be very expensive due largely to the need for an autoclave. Autoclaves control the temperature and pressure during curing and can be expensive devices, especially if the vessels to be manufactured are large.

It will be appreciated from the foregoing that there is a need for an all-composite pressure vessel that has no need of a metal liner, and preferably has no need for autoclaving during fabrication. The present invention satisfies this need.

BRIEF SUMMARY OF THE INVENTION

The present invention resides in a reliable pressure vessel for containing cryogenic or other materials but without the weight and high cost usually associated with such vessels. Briefly, and in general terms, the pressure vessel of the present invention comprises an inner shell fabricated from composite material, over which a composite outer shell is filament wound. Both liner and outer shell utilize out-of-autoclave cured composites. In the disclosed embodiment of the invention, the vessel has a cylindrical body with geodesic iso-tensoid dome contours, at each end. The vessel includes polar end fittings, which are bonded to the dome and provide a means for filling and evacuating. The polar end fittings may be metallic or a composite material.

The vessel further comprises a skirt at each end of the vessel, extending cylindrically over a portion of each domed end. A cyrogenically compliant, adhesive shear ply is used at the skirt/dome y-joint area to reduce stress peaking at the interface.

Any of a variety of composite materials may be used for fabricating the liner shell and the outer surface of the vessel, including fiberglass and carbon in fabric and fiber form. The vessel may also include a coating of a cryogenically compliant material applied to the inside surface of the inner shell prevent micro-cracking of the inner surface during cryogenic applications and to reduce the permeability of the composite liner.

The invention may also be defined as a process for fabricating a pressure vessel for both cryogenic and non-cryogenic materials. Briefly, and in general terms, the process comprises the following steps: 1) Preparing a tool, which is shaped to conform to the inner surface (inner mold line) of the pressure vessel, on which to fabricate the liner shell. Polar end fittings are set and bolted in place, but not bonded, onto the tool body at each polar end of the vessel, where openings are desired into the vessel. 2) Layers of composite material are laid-up or filament wound over the tool to form a composite liner shell. For hand lay-up the composite liner is formed in two halves. Filament wound liners are fabricated in one piece and then cut in half along the center cylinder. The liner shell is then cured out of autoclave with heat lamps. 3) The tool and the polar end fittings are removed from the shell. 4) The polar end fittings are bonded onto the dome ends of each half of the liner. 5) The two halves of the liner are bonded together with a splice band (or "bellyband") to form a complete liner shell for the vessel. 6) The liner shell is then mounted on a filament-winding machine and over-wrapped with multiple layers of reinforcement fiber. Curing is performed out-of-autoclave with heat lamps.

The step of assembling the two half portions of the liner shell includes forming an annular inner bellyband of composite material. The inner bellyband has an outside diameter selected to fit along the inside surface of the liner shell. The step of assembling the two half portions further includes bonding the inner bellyband with adhesive onto one of the shell halves, leaving half of the axial length of the inner bellyband protruding from the liner half; securing the protruding part of the inner bellyband with adhesive to the other shell half; and then forming an outer bellyband of composite material around the liner shell, to strengthen the joint between the two halves and to complete their assembly.

Further, the step of installing the polar end fittings includes preparing the surface of the fittings and the inner surface of the shell to receive the fittings; applying an adhesive to the inner surface of the shell, specifically around the opening to receive the fittings; inserting the fittings in the opening and applying pressure to adhere the fittings in the opening; applying annular layers of composite material over the fitting from inside the shell and curing the adhesive and the layers of composite material on both sides of each fitting, using heat lamps in an out-of-autoclave curing process.

The step of a filament winding includes winding multiple helical layers extending over the entire surface of the structure and multiple hoop layers extending over only the cylindrical portion of the surface. In the disclosed embodiment of the invention, the vessel includes a cylindrical body with geodesic, iso-tensoid dome profiles, and the step of filament winding further includes forming a skirt structure by filament winding multiple hoop layers over hand lay-up fabric.

It will be appreciated from the foregoing summary that the present invention represents a significant advance in the field of pressure vessel fabrication for cryogenic, space and other applications. In particular, a vessel formed by overwrapping a composite liner shell with additional composite material has relatively low weight and low cost. Other aspects and advantages of the invention will become apparent from the following more detailed description, taken in conjunction with the accompanying drawings.

BRIEF DESCRIPTION OF THE SEVERAL VIEWS OF THE DRAWINGS

FIGS. 14A, 14B and 14C are diagrammatic views depicting installation of the inner bellyband in a liner half portion.

DETAILED DESCRIPTION OF THE INVENTION

Figure 1:
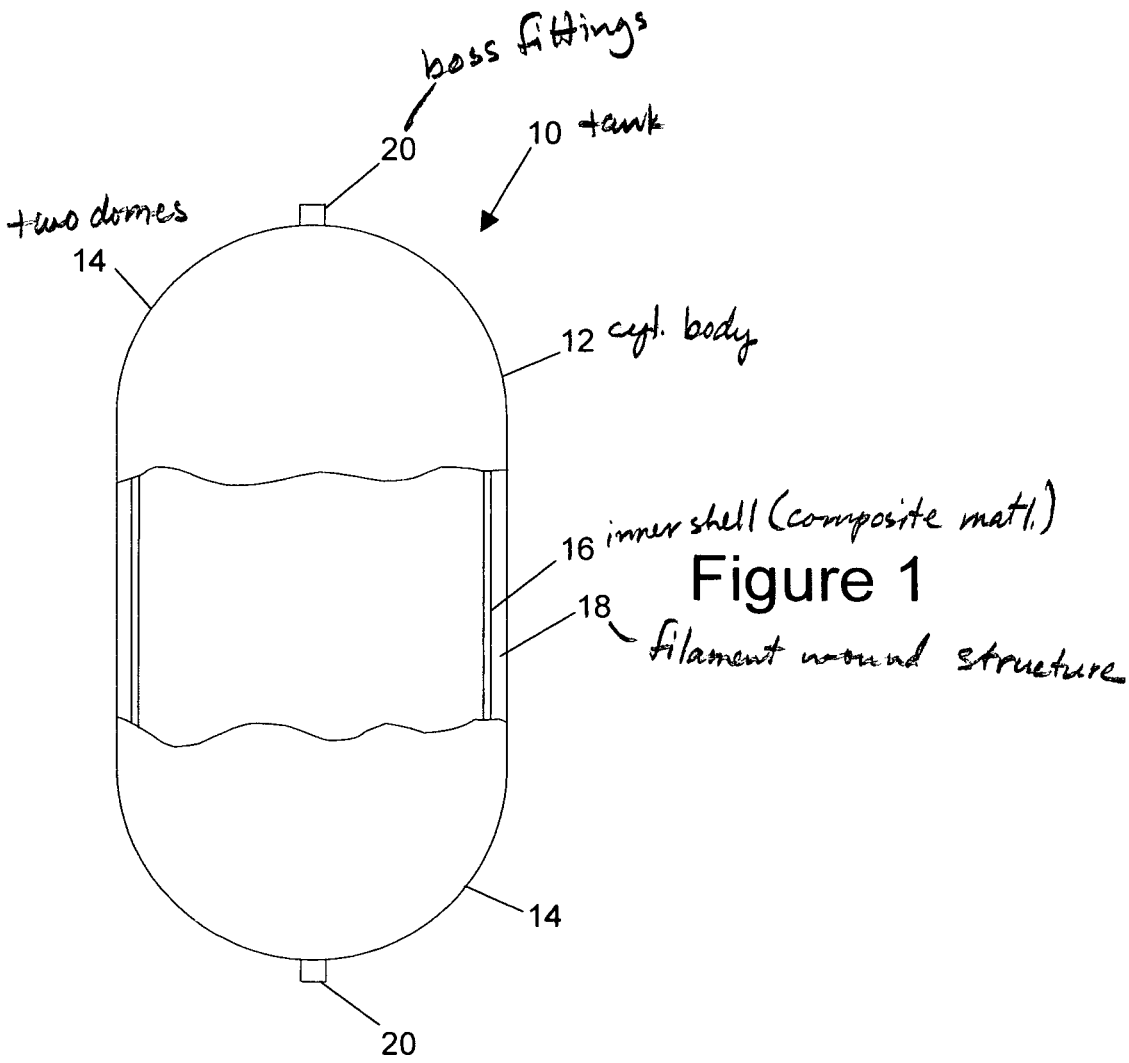
FIG. 1 is a diagrammatic view of a pressure vessel constructed in accordance with the invention.

As shown in the drawings for purposes of illustration, the present invention pertains to pressure vessels for use in applications in which weight, cost, or both are important concerns. Although the invention was made with launch vehicle propellant tanks and other space vehicle applications in mind, it may also be usually applied in other fields. In the past, pressure vessels of this general type have been made to include a metal liner, or have been made in part from composite materials that must be cured the controlled temperature and pressure environment of an autoclave.

In accordance with the present invention, a pressure vessel is formed to include an inner shell of a composite material, which is then filament wound with an outer composite structure and cured out-of-autoclave. Most pressure vessels are either spherical or cylindrical in shape. The one described here by way of example is cylindrical with domed, geodesic, iso-tensoid dome profiles. However, for convenience of illustration the dome profiles are shown in the drawings as hemispherical. Thus, as shown in FIG. 1, the tank, indicated generally by reference numeral 10, has a generally cylindrical body 12 and two ends domes 14. As shown only diagrammatically, and not to scale. The tank 10 includes an inner or liner shell 16 of composite material and an filament wound outer structure 18, also of composite material. As will be described in detail below, the liner shell 16 is formed as two practically identical halves and later joined at the midpoint of the length of the cylindrical body 12. Boss end fittings 20 are bonded at the center of each dome 14 before the halves of the inner shell are joined. Each boss fitting 20 provides an opening through which fluids are placed in or removed from the tank 10, and may include a threaded end portion to engage a sealing cap or pipe coupling (neither of which is shown). The boss fittings 20 may be of aluminum or another suitable metal, or may themselves be of a composite material.

The remaining figures depict the fabrication steps performed in accordance with the present invention as described below. It will, be understood, of course, that the specific steps and materials used are disclosed for purposes of illustration only.

Figure 2:
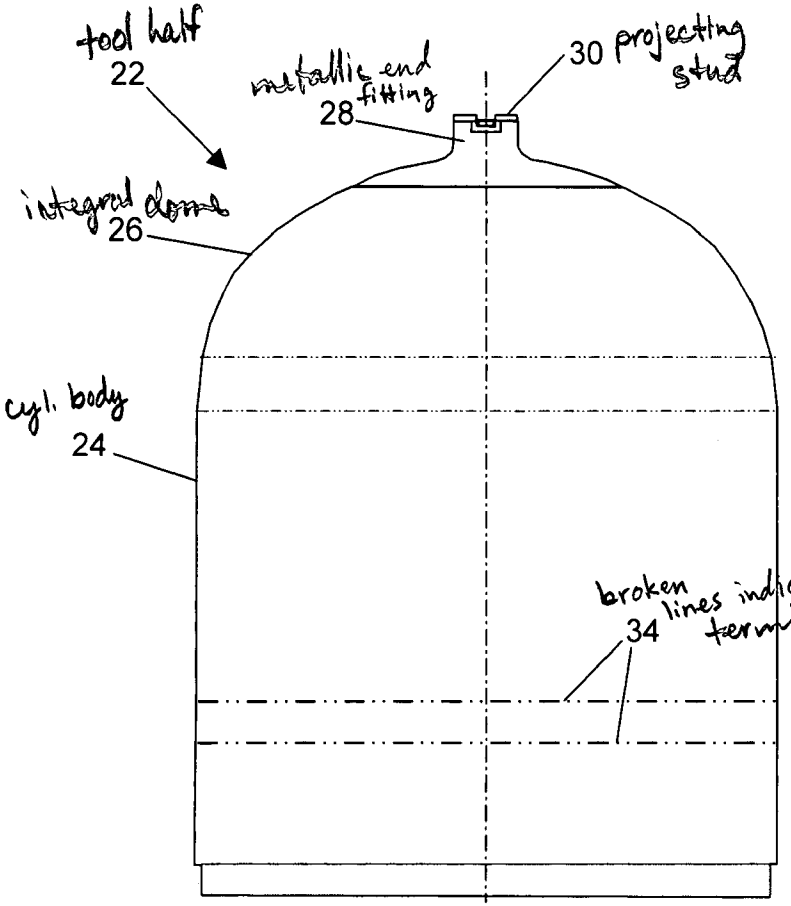
FIG. 2 is an elevational view of a tool for fabricating a half portion of a liner shell in accordance with one aspect of the invention.

(1) Preparation of layup tool:

The liner shell 16 is fabricated by hand layup or wrapping of composite material over two male layup tool halves, one of which is shown at 22 in FIG. 2. Alternatively, a single layup tool (not shown) could be used to form the whole liner shell 16 as one piece. However, because the method of the invention as presently contemplated requires that the bosses 20 be installed from the inside of the liner shell 16, the shell formed over a single layup tool would need to be cut in half after layup and curing. Each tool half 22 includes a cylindrical body 24 and an integral dome 26, with a metallic end fitting 28 connected to the dome. The metallic end fitting 28 includes a projecting stud 30 and an annular flange 32 that conforms with the inner surface of the dome 26. The same tool 22 may be used in the fabrication of tanks of various sizes, by terminating layup at a selected point on the cylindrical body 24, as indicated by broken lines 34. Tool removal is further facilitated by the application of wax or another mold release coating on the tool surface before layup begins.

Figure 3:
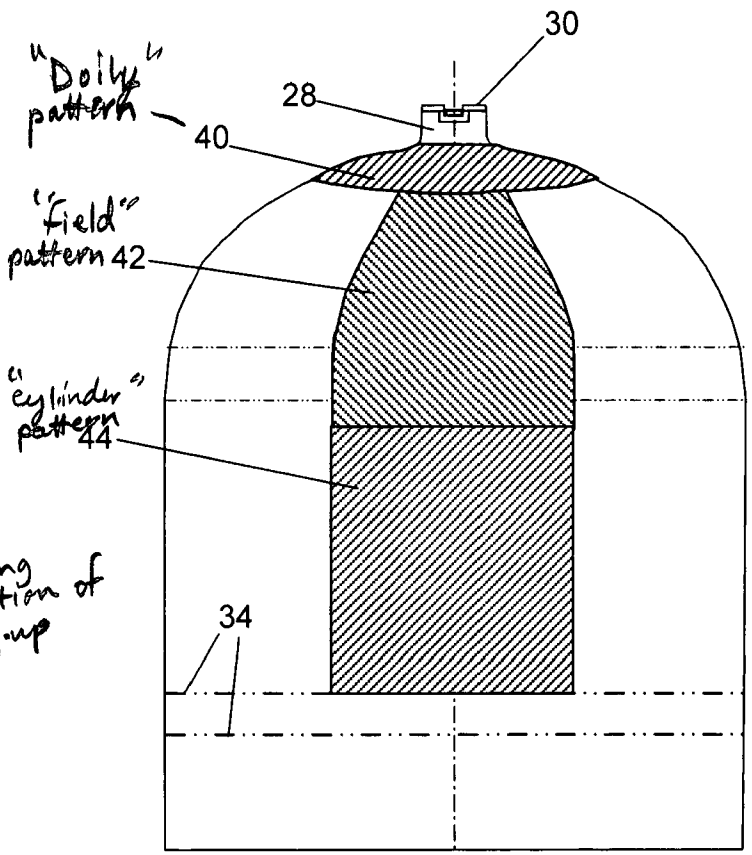
FIG. 3 is a view similar to FIG. 2, but showing the geometry of the hand lay-up fabric around the polar and fitting, the dome, and the cylindrical portions of the vessel.
Figures 4, 5:
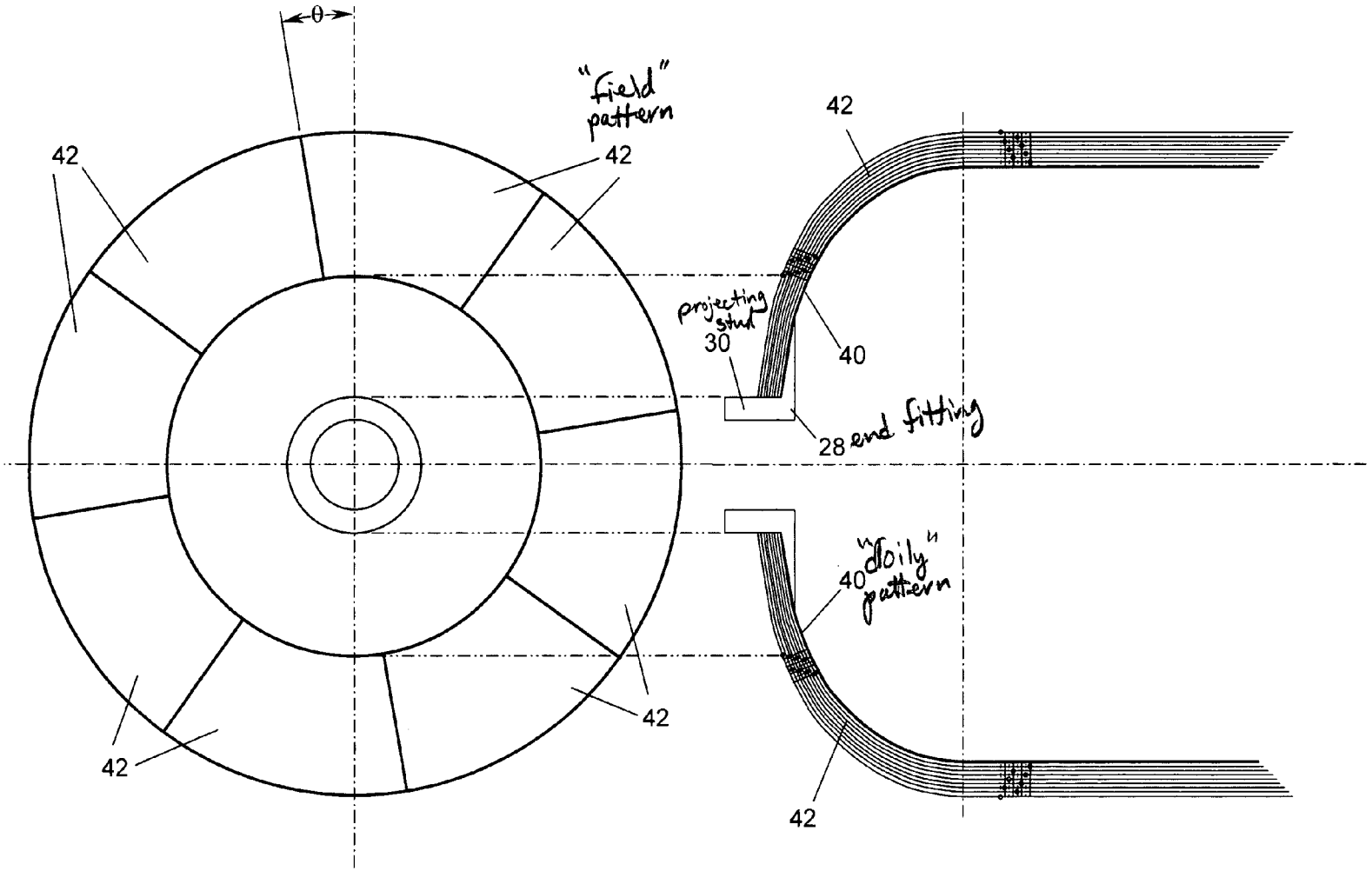
FIG. 4 is a top plan view of the liner shell half portion, showing the arrangement of fabric around the polar end fitting and the dome.
FIG. 5 is a cross-sectional cut corresponding to FIG. 4, showing eight ply layers laid on the tool.

(2) Linear shell layup process:

Although the hand layup process is described here, it will be understood that a machine wrapping process may be used with equivalent results. As shown in FIG. 3, each layer or ply of material is laid on the tool in accordance with a specific layup schedule. Because of the surface curvature of the liner shell 16, fabric for fabricating the liner shell was cut using three different patterns. "Doily" pattern 40 was used around the boss end fitting 20. "Field" pattern 42 was used around the dome and the dome-cylinder interface. "Cylinder" pattern 44 was used around the cylinder. All of the patterns are cut from flat fabric, such as selected fiberglass or graphic fabric. Doily pattern 40 is annular in shape, with a central hole to permit placement over the stud 30 of the metallic end fitting 28. Cylinder pattern 44 is rectangular in shape and is used only on the cylindrical body 24 of the tool 22. Field pattern 42 is of irregular shape, as further described below, and is used in the dome portion 26 of the tool 22. In the illustrated layup process, each layer is made up of eight adjoining cylindrical pattern sections encircling the cylindrical body 24 of the tool 22, and a tier of eight field pattern sections adjoining the cylindrical sections. The layer also includes a single doily pattern section butted against the edges of the eight field sections. FIG. 4 is an end view of the laid-up liner shell 16, showing a doily pattern section 40 and eight field pattern sections 42. FIG. 5 is a cross-sectional view of a portion of the laid-up liner shell 16, showing the metal end fitting 28 and showing that there are eight layers in all.

Figure 6:
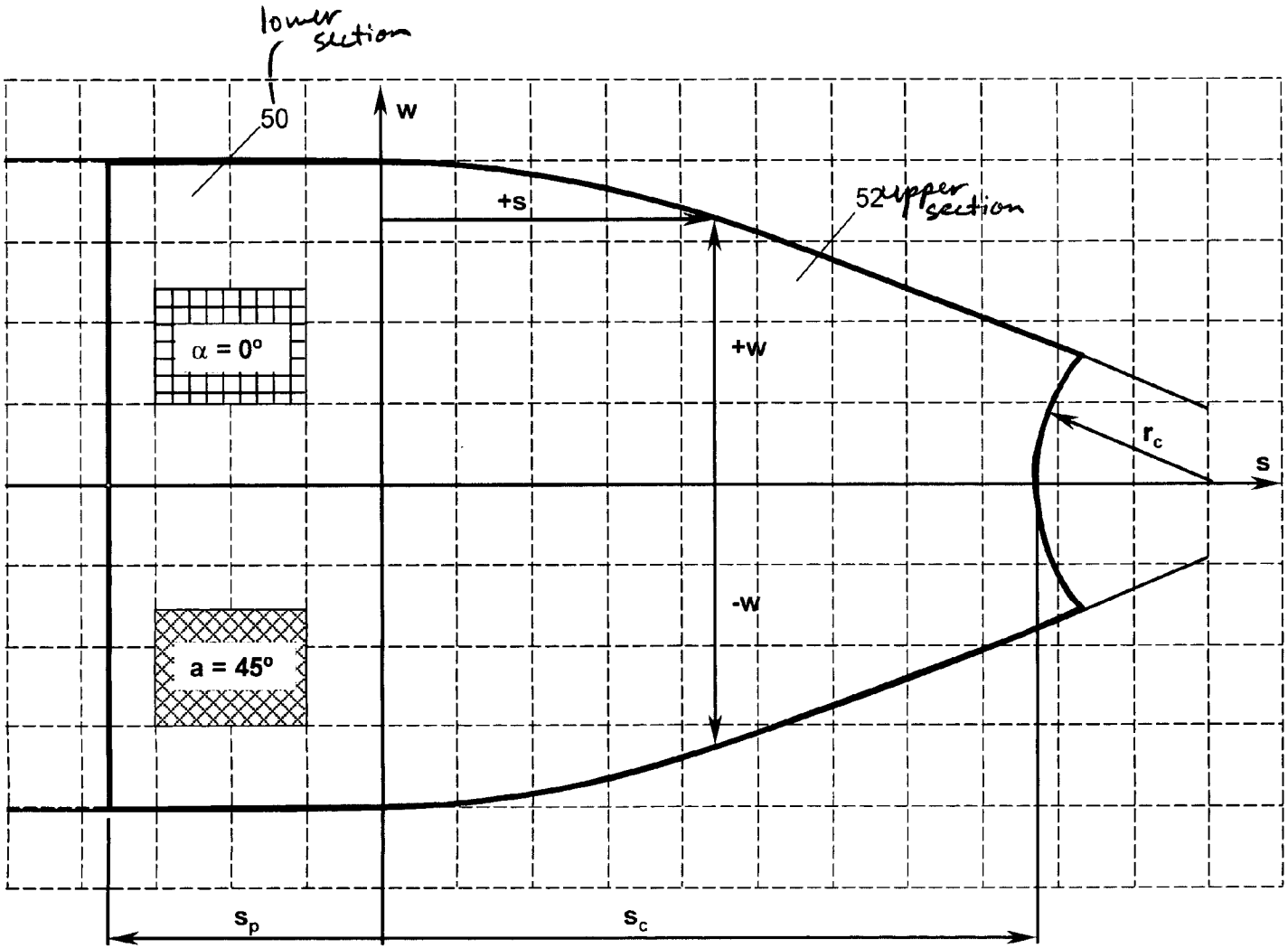
FIG. 6 is a diagram of a template for cutting field pattern sections for the liner shell.

FIG. 6 is a plan view of a template for a field pattern section 42. The field pattern template is symmetrical about a longitudinal axis 's' and has a half-width 'w' that is predefined for each ordinate in the s-axis direction. The field pattern template includes a lower section 50 with parallel side edges and a length $s_p$ measured in the s-axis direction, and an upper section 52 with convexly curved side edges and a length $s_c$ measured in the s-axis direction. The lower sections 50 abut over the cylindrical section 24 of the took 22 and form the upper cylindrical section 24 of the liner shell. The upper sections 52 abut over the dome portion 26 of the tool 22. The lower portion 52 of the pattern includes a concave arcuate edge of radius $r_c$ selected to form a circular edge with adjacent field pattern sections 42. The specific width, length and radius measurements of each field pattern section are selected to provide abutting sections when laid up on the tool 22. The ply fiber direction in the eight plies 42 is alternated between 0° and 45° with respect to the s axis, for successive pairs of layers. This is, the fiber angle is 0° for plies #1 and #2, 45° for plies #3 and #4, 0° for plies #5 and #6, and 45° for plies #7 and #8.

Figure 7:
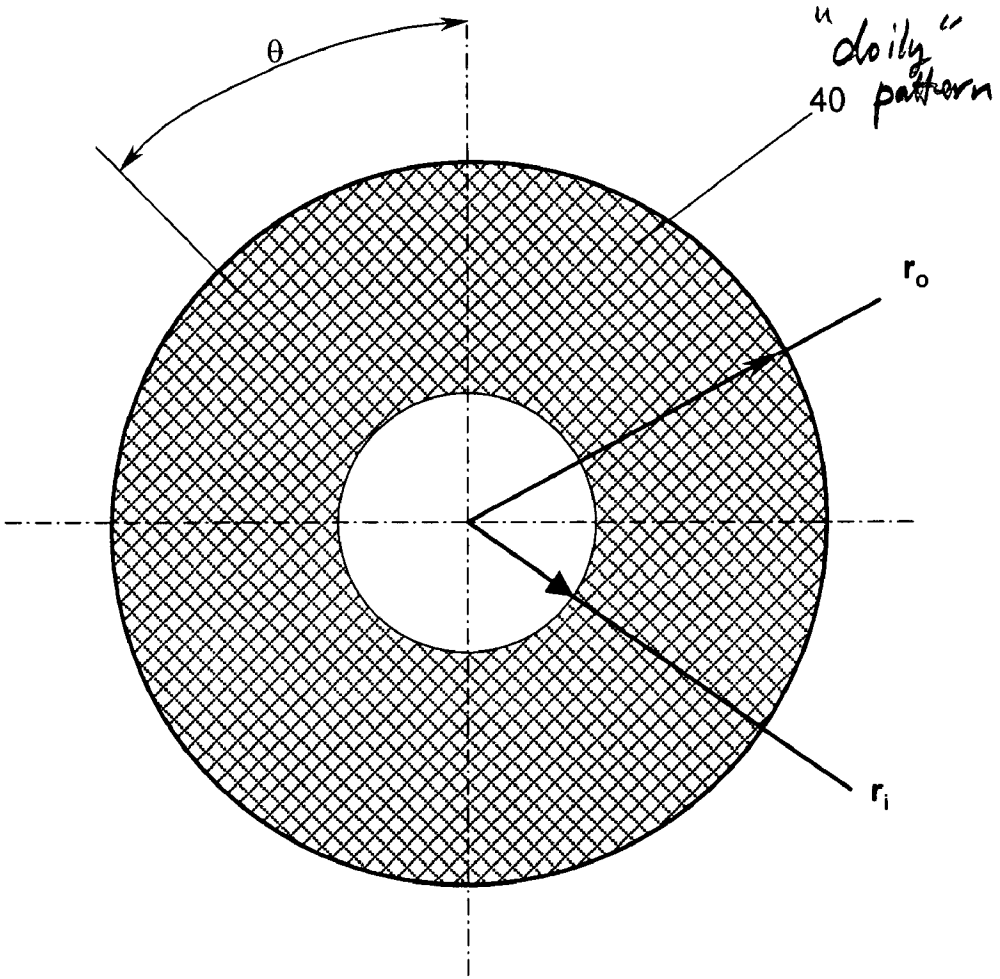
FIG. 7 is a diagram of a template for cutting doily pattern sections used around the polar end fitting on the liner shell.
Figure 8:
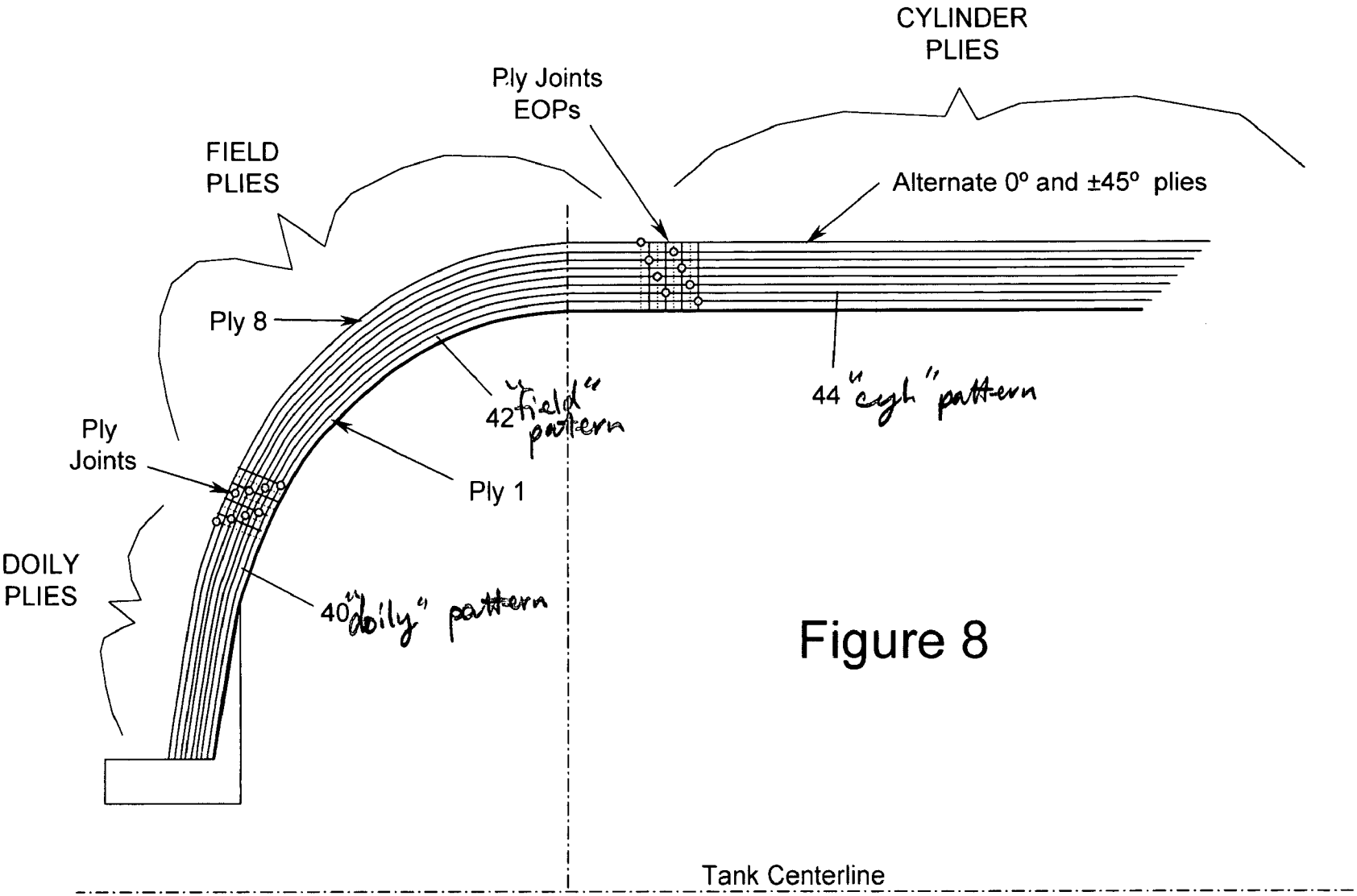
FIG. 8 is a fragmentary cross-sectional cut showing how ply joints are stepped and staggered.
Figure 9:
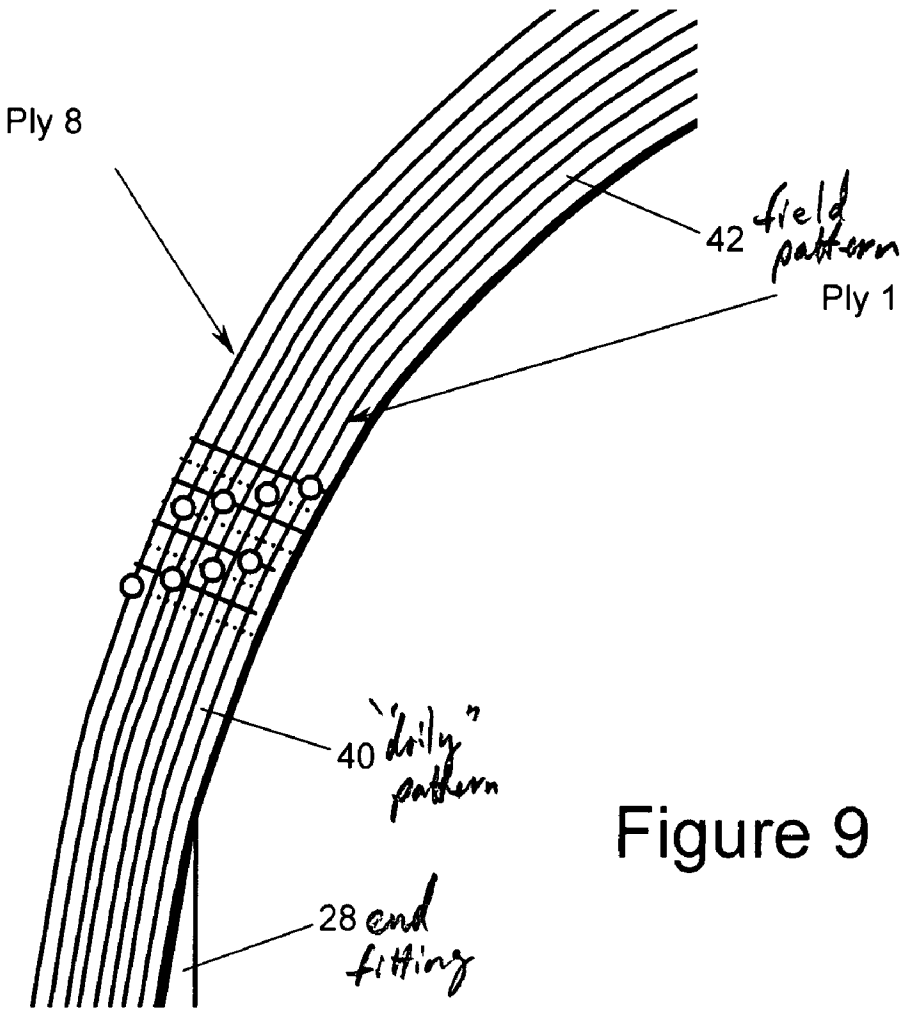
FIG. 9 is an enlarged and cross-sectional cut similar to FIG. 8, showing how adjacent ply joins are stepped and staggered.

FIG. 7 is a plan view of a template for a doily pattern 40, the shape of which is annular, having an outer radius $r_o$ and an inner radius $r_i$, which are defined in accordance with a lay-up schedule for a specific tank size. FIG. 8 depicts how multiple layers of doily sections 40, field sections 42 and cylinder sections 44 are laid up on the tool 22. The lay-up sequence includes the steps of: (1) laying up the doily section 40, (2) laying up eight field section segments 42 butted to the doily section and butted to each other, with the last segment trimmed to fit, (3) laying up eight cylinder section segments 44 butted to the field section segments and to each other, with the last segment trimmed to fit, and (4) repeating the foregoing steps to apply a total of eight layers. The section segments are precisely dimensioned to provide section joints that are both stepped and staggered, as best shown in FIG. 9, which depicts the joints between eight layers of doily sections 40 and eight layers of field sections 42. Butt-jointed edges of plies in the first and other odd-numbered layers are offset or staggered with respect to the edges of plies in the second and other even-numbered layers. In addition, the butt joints of the odd-numbered layers are stepped with respect to each other, i.e., they are positioned at successively spaced positions. As a result, a butt joint on any one layer completely covered by at least one ply above or the joint. Butt joints in middle layers, i.e., not the first and last layers, are completely covered by plies both above and below the joint.

After lay-up of all eight ply layers is complete, the liner shell is cured with heat lamps.

Figures 10A, 10B, 10C:
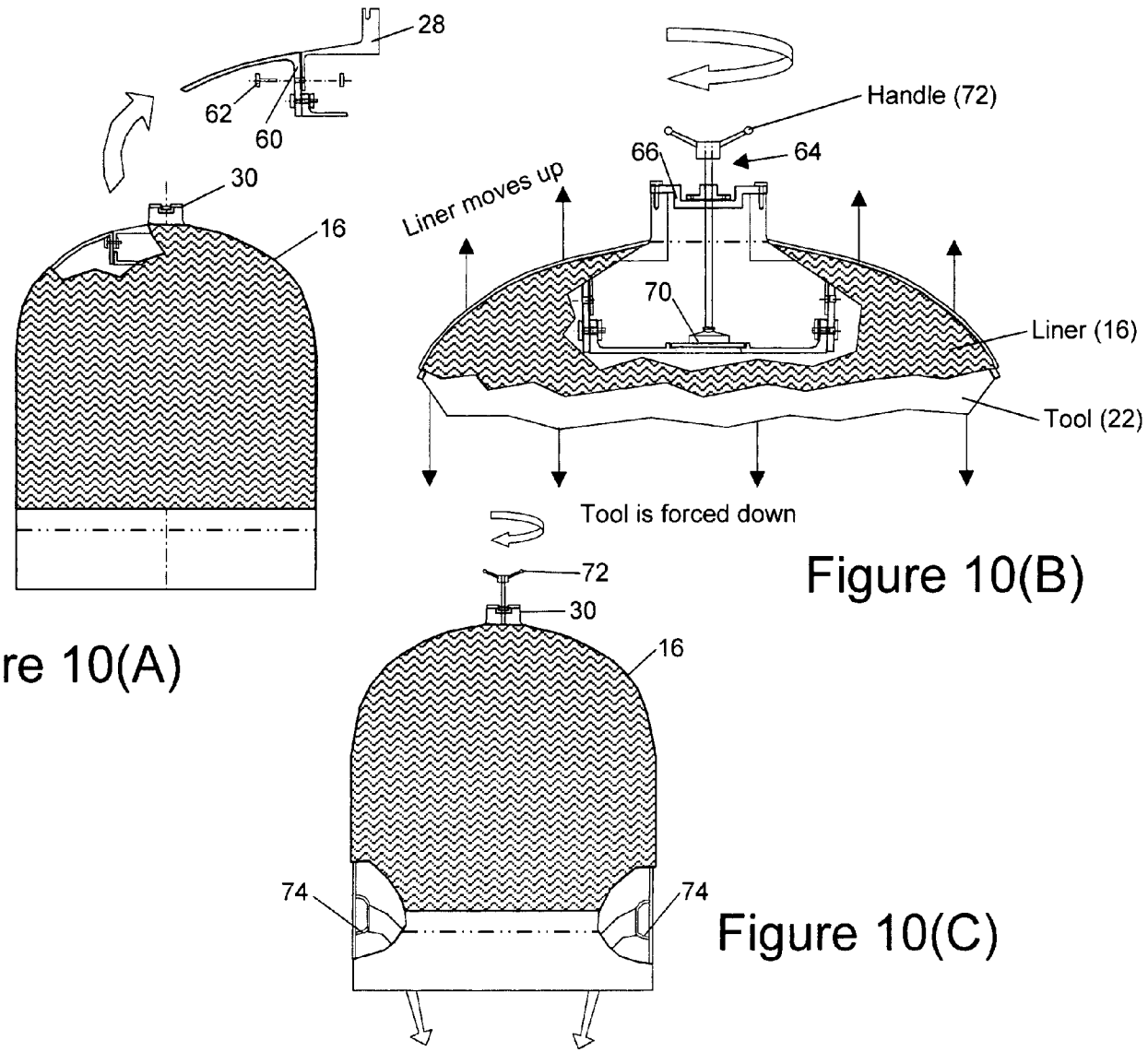
FIGS. 10A, 10B and 10C are diagrammatic views depicting how the tool is removed from the liner shell.

(3) Separation of tool from liner shell:

As best shown in FIGS. 10A, the metal end fitting 28 was joined, prior to fabrication of the liner shell, to a flange 60 inside the tool 22 by fasteners 62. As a first step in removing the tool 22 from the liner shell 16, the fasteners 62 are removed. Then, as shown in FIG. 10B, a tool removal assembly 64 is installed. The assembly 64 includes an end cap 66 that is secured to the top of the metal end fitting 28, a threaded rod 68 extending through a central hole in the end cap 66, and an end plate 70 secured to the lower end of the rod 68. The end plate 70 impinges on a surface of the tool 22. When an operating handle 72 at the top of the threaded rod 68 is rotated, the end plate 70 applies downward force on the tool 22 and an upward force on the metal end fitting 28. This action tends to loosen the liner shell 16 in the dome area. Simultaneously, as shown in FIG. 10C, the tool 22 is pulled downward and inward by handles 74, separating the cylindrical sides of the tool 22 from the sides of the liner shell 16 and facilitating complete removal of the tool. Finally, the assembly 68 and the metal end fitting 28 are removed from the liner shell 16.

Figure 11:
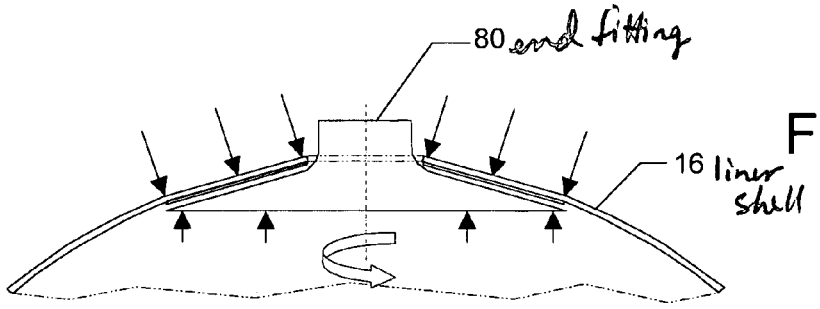
FIG. 11 is a cross-sectional cut depicting installation of a polar fitting in an opening through the liner shell.

(4) Preparation of liner shell for polar end fitting installation:

After the removal of the tool 22, the innermost layer of the liner shell 16 is checked for voids or porosity, and the cylindrical edge of the liner shell is trimmed to match the dimensions needed for the applicable tank length. As shown in FIG. 11, the next step is to dry-fit a tank end fitting 80 to the liner shell 16 in the cut-out-area formerly occupied by the metal end fitting 28. The end fitting 80 must seat smoothly against the liner surface and not bind in the opening. The area at which the fitting 80 contacts the innermost layer of the liner shell 16 preferably includes a peel ply that can be removed at this point in the process to provide a good bonding surface for the boss. The bonding surface of the fitting, if of aluminum, is scuffed with an 80–120 grit sand paper, and both surfaces are cleaned with a solvent such as acetone, to ensure that the both surfaces are clean. Threaded holes of the end fitting 80 are covered with tape for protection.

(5) Bonding of end fitting into liner shell:

This description assumes that the end fitting 80 is of aluminum. A suitable adhesive, such as a two-part epoxy (e.g., Dexter Hysol EA9361) is mixed and applied as a smooth thin layer to the innermost layer of the liner shell 16 over the annular area where the boss is to be installed. The preferred thickness of the layer may depend on strength and environmental requirements of the tank. The end fitting 80 is inserted until contact is made with the adhesive layer, then rotated slowly to ensure good contact, while applying pressure to allow any trapped air to escape through holes (not shown) in the flange of the end fitting 80. Entry of adhesive into the holes provides improved adhesive contact. Any excess adhesive is smoothed around the end fitting periphery to leave a smooth interface. Finally the adhesive is cured while maintaining pressure on the end fitting 80 to ensure a void free adhesive interface.

Figure 12A:
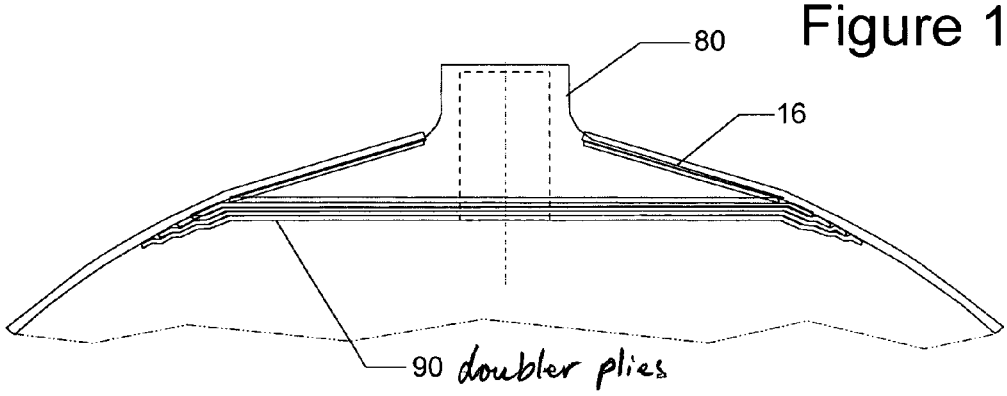
FIG. 12A is a cross-sectional cut depicting the installation of doubler plies to strengthen the end fitting-to-liner interface.
Figure 12B:
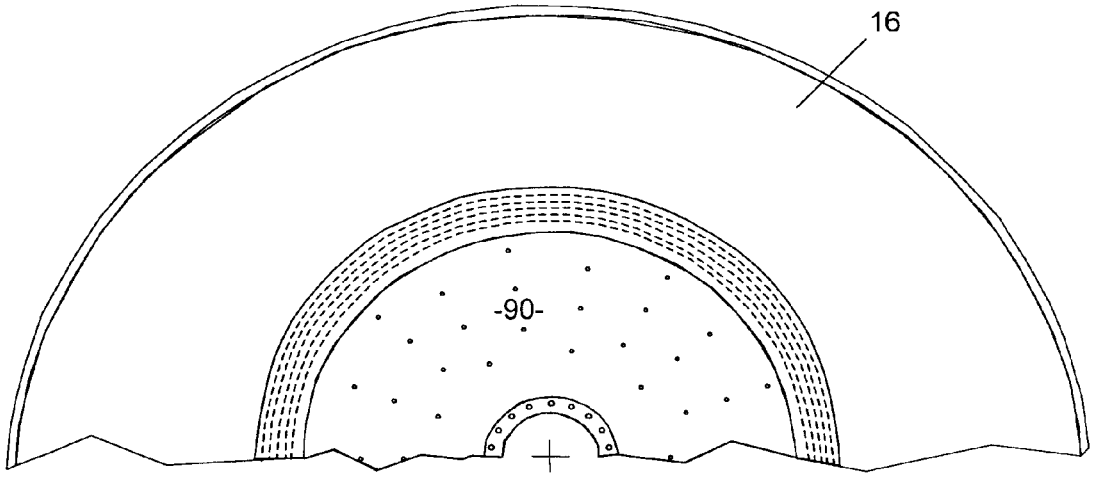
FIG. 12B is a fragmentary bottom plan view corresponding to FIG. 12A.

(6) Boss doubler ply fabrication process:

As shown in FIG. 12A and 12B, annular end fitting doubler plies 90 are applied successively to sandwich end fitting flange 80 between the doubler plies 90 and the liner shell 16, thus forming a double-lap shear joint. Each new ply 90 is larger in outer diameter than the previously applied one, and provides a radial overlap of about a centimeter or more. The doubler plies 90 are of the same material as the liner shell 16. The ply fiber direction is alternated between 0° and 45° from one ply layer to the next.

Figures 13A, 13B, 13C:
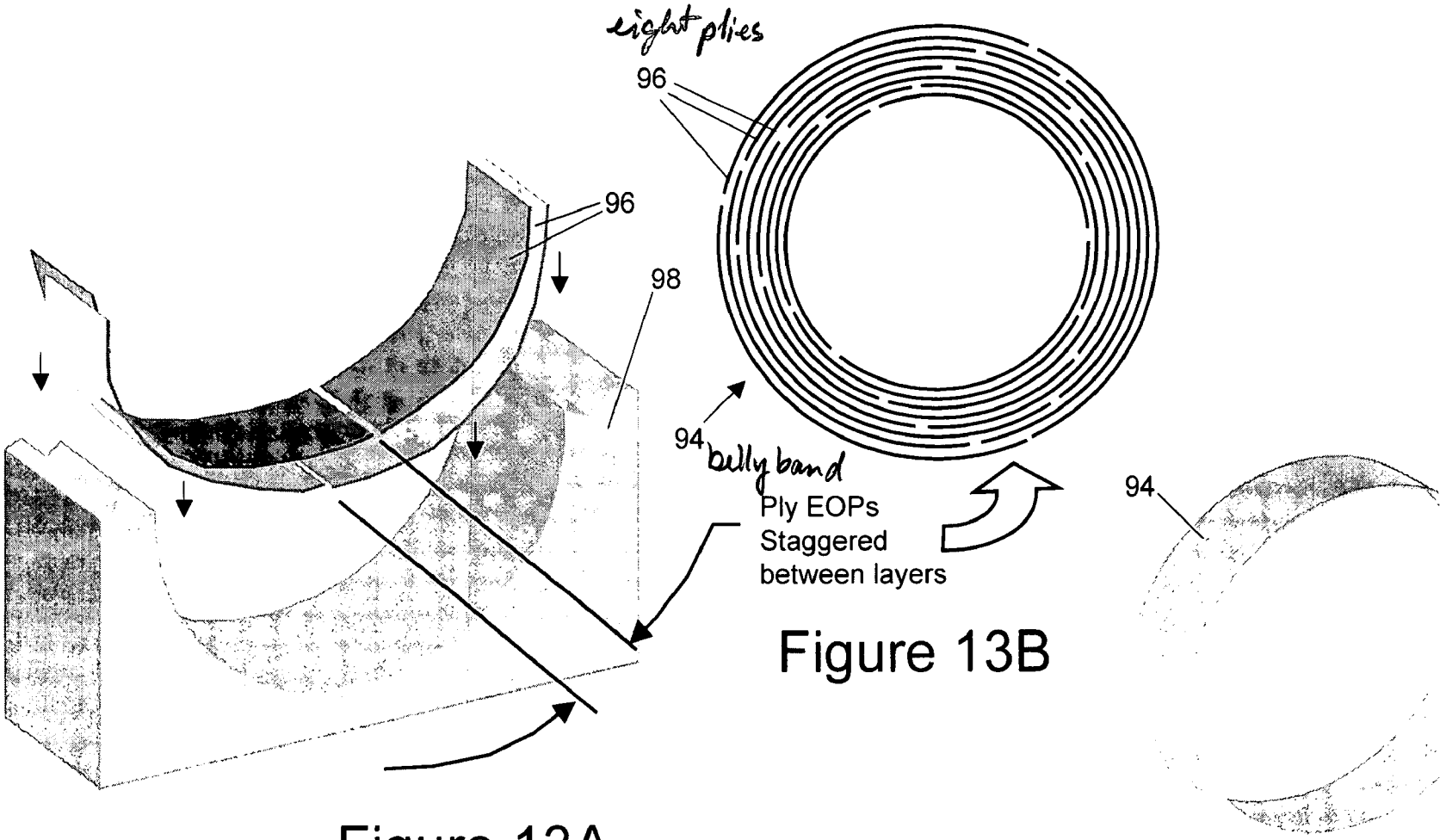
FIG. 13A is a diagrammatic perspective view showing fabrication of an inner bellyband.
FIG. 13B is a diagrammatic end view of the inner bellyband, showing the locations of ply joints.
FIG. 13C is a perspective view of the completed inner bellyband.

(7) Internal bellyband fabrication process:

As shown in FIGS. 13A–13C, an internal bellyband 94 is fabricated by laying up eight plies 96 of material on the inside of a cylindrical tool 98, only half of which is shown. Each of the plies 96 comprises three strips that are butt-joined to form a continuous band, and the butt joints are staggered circumferentially such that no two joints occur at or near the same location. The ply fiber direction is alternated between +45° and −45° from layer to layer. The completed bellyband 94 preferably includes a final peel ply and is cured at room temperature. The ply material may be, for example, 6781 Style S2 glass fiber fabric.

(8) Bonding internal bellyband into first liner half:

As shown in FIGS. 14A–14C, the bellyband 94 is first dry-fitted into one half of the liner shell 16. The innermost of the liner shell 16 is scuffed with sandpaper and the outermost layer of the bellyband 94 is similarly treated, unless a peel ply was used before the first ply was applied to the tool during fabrication. Both surfaces are then cleaned with a solvent, such as denatured alcohol, and a layer of adhesive, such as Dexter Hysol EA9361, is applied to the innermost layer of the liner shell 16 half over the area of contact with the bellyband 94. The bellyband is then inserted into the liner shell with a rotational motion, until half of its width is covered by the liner. The joint is then cured, leaving the installed bellyband as shown in FIG. 14C.

Figure 15B:
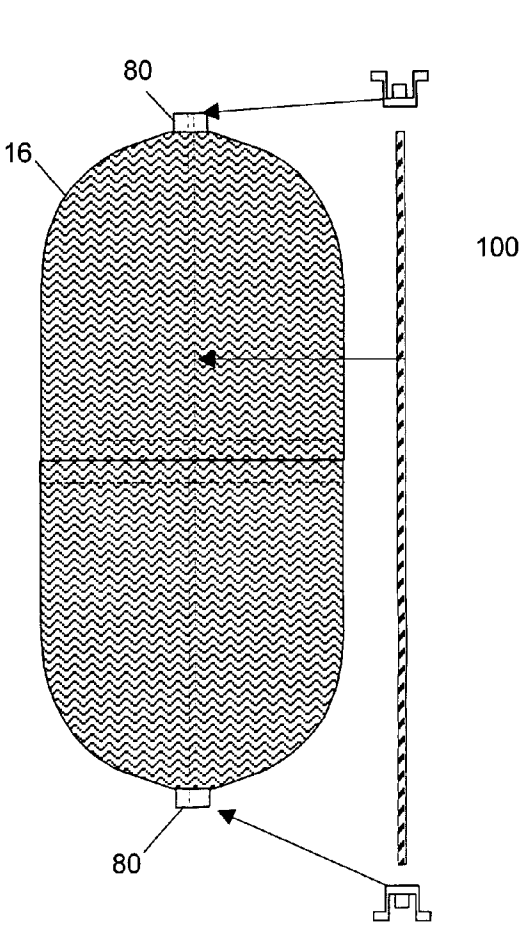
FIGS. 15A and 15B are diagrammatic views depicting assembly of the two half portions of the liner shell.
Figure 15A:
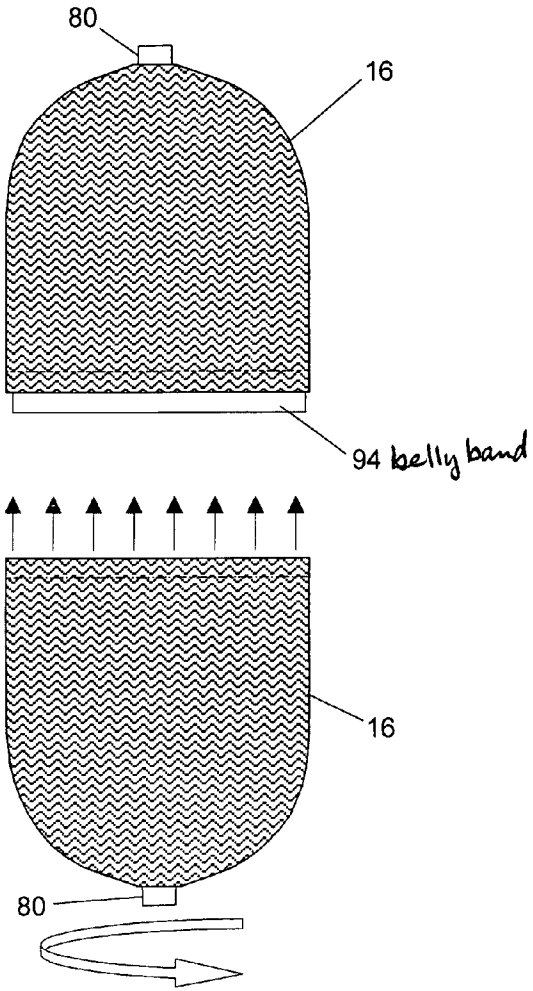

(9) Bonding liner halves together:

As shown in FIG. 15A, the two halves of the liner shell 16 are assembled by first preparing the innermost surface of the second half and the outermost surface of the bellyband, by scuffing with sandpaper and cleaning with alcohol. Adhesive such as Dexter Hysol EA9361 is applied to the innermost layer of the second half, and the two halves are engaged with a rotational motion. The assembled liner shell 16 is cured in a vertical position, as shown in FIG. 15B, using a clamp assembly 100 that extends through the two bosses 80 and applies positive pressure to clamp the halves together during curing. The same adhesive is preferably applied as a leak barrier to the innermost surfaces of the two halves prior to bonding the two together. Film layers have been used in the past, especially for cryogenic tanks, but the use of a two-part adhesive simplifies fabrication and is at least as reliable as a film liner.

Figure 16A:
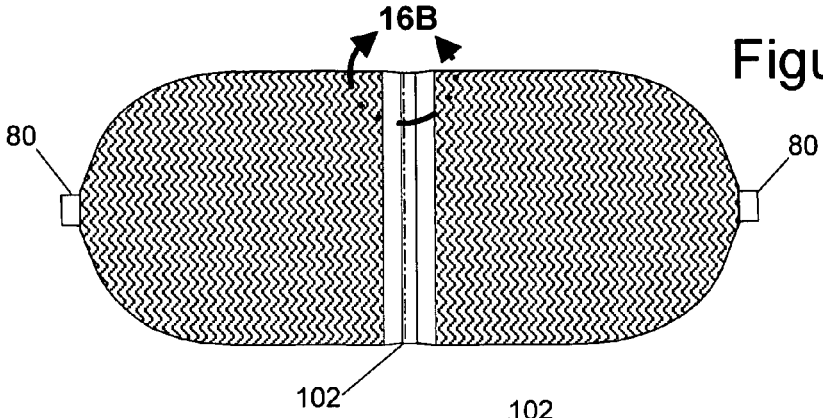
FIG. 16A is a diagrammatic view of the assembled liner shell with a circumferential groove formed for an outer bellyband.
Figure 16B:
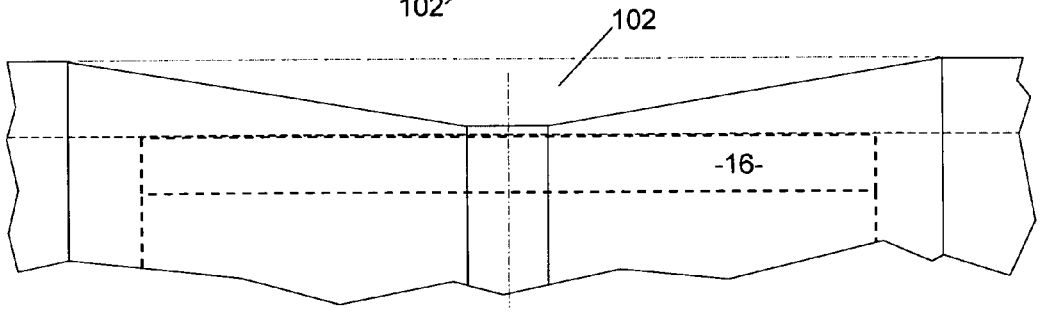
FIG. 16B is an enlarged, cross-sectional cut showing the groove formed for an outer bellyband.

(10) Preparing liner and applying outer bellyband:

As shown in FIGS. 16A and 16B, the joint seam between the two halves of the liner shell 16 is prepared by tapering the outermost layer to form a shallow V-shaped groove 102 over the seam. In forming this groove 102, the outermost layer is sanded or machined through almost its entire thickness at the seam.

Figure 17:
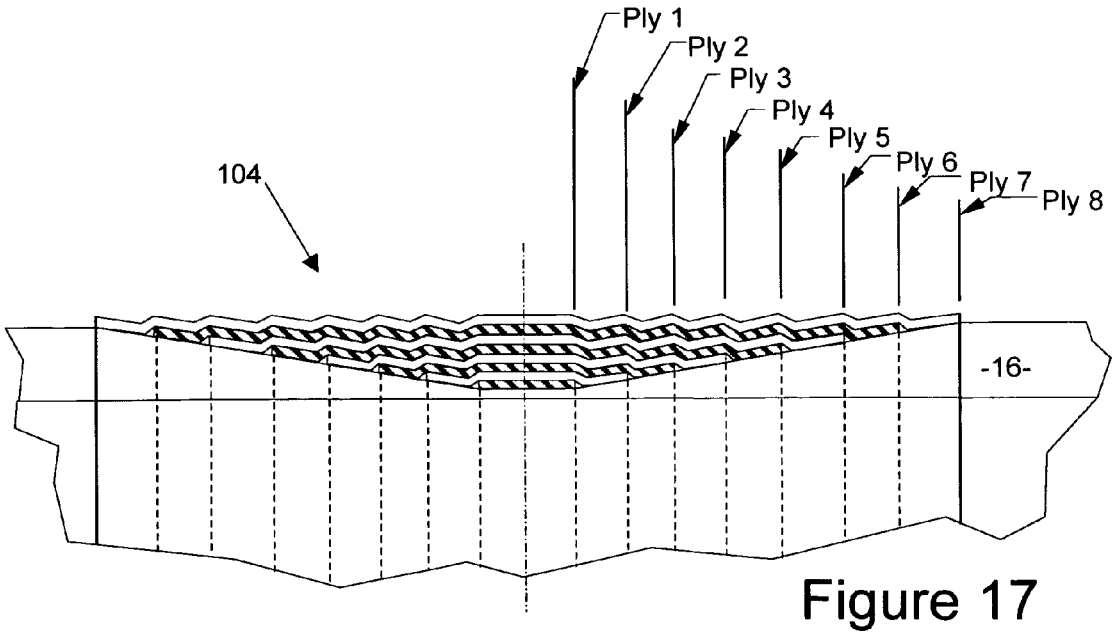
FIG. 17 is a diagrammatic cross-sectional view showing how eight plies are employed to form the outer bellyband.

As shown in FIG. 17, an outer bellyband 104 is formed by applying eight plies of successively greater width to the groove 102. The ply fiber direction is varied from ply to ply. For example the eight successive plies may have fiber angles of 0°, 0°, +45°, −45°, 0°, 0°, +45°, and −45°, respectively. The ply material may be, for example, of fiberglass cloth, such as 6781 Style S2 glass fiber fabric. The ply thickness values are preferably chosen such that the final play application will result in a one-ply excursion beyond the nominal outermost layer of the liner shell 16. Then, a peel ply is applied to the bellyband 104 and the assembly is cured at room temperature until tack free. Finally, heat is applied, up to 170° F. for six to eight hours for a final cure. After curing, any remaining peel ply material is removed from the outermost layer and the surface is checked for notable signs if dryness, porosity or other non-conformities.

Figure 18:
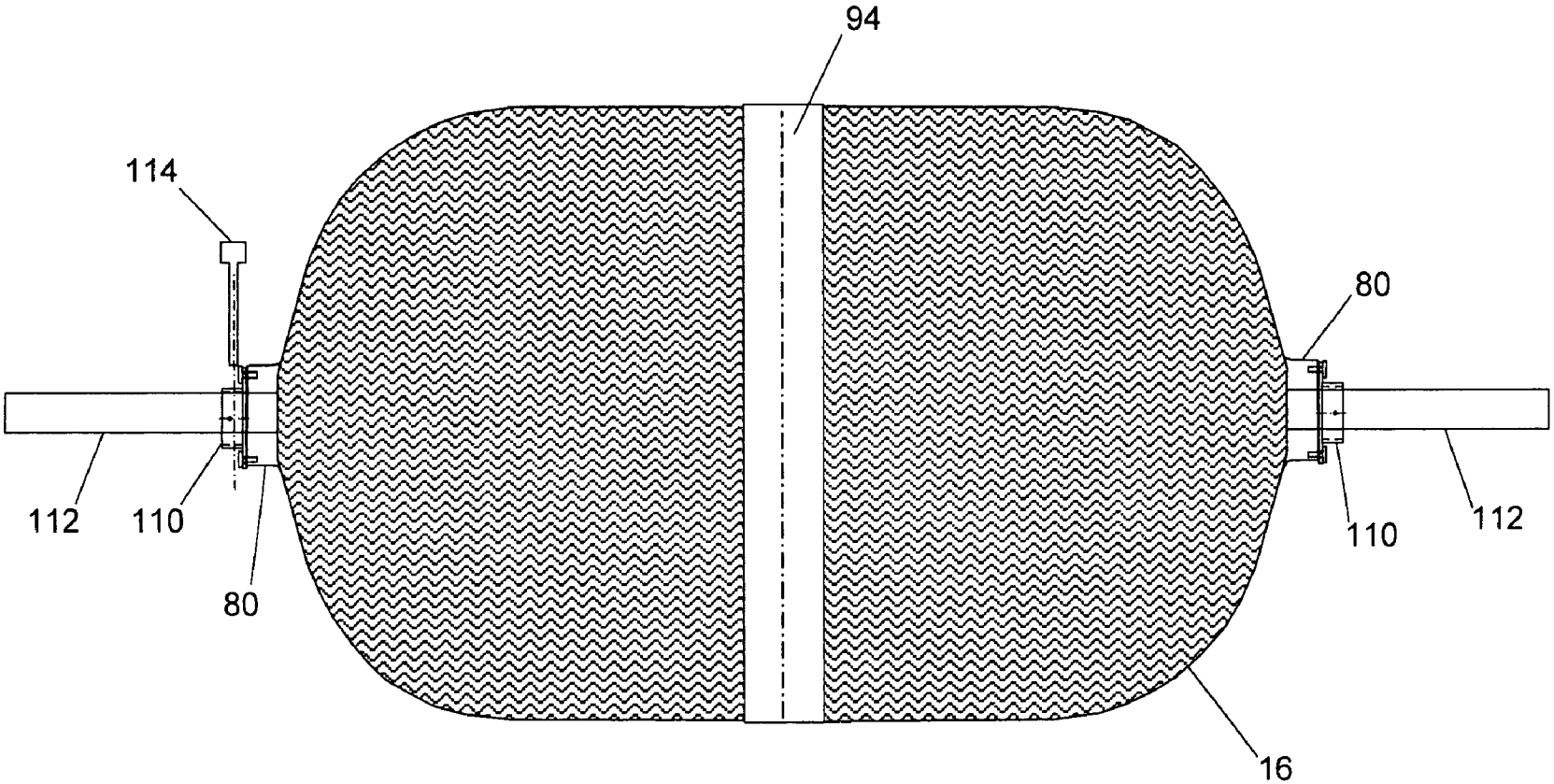
FIG. 18 is a diagrammatic view of the completed liner shell mounted on winding shaft.
Figure 19:
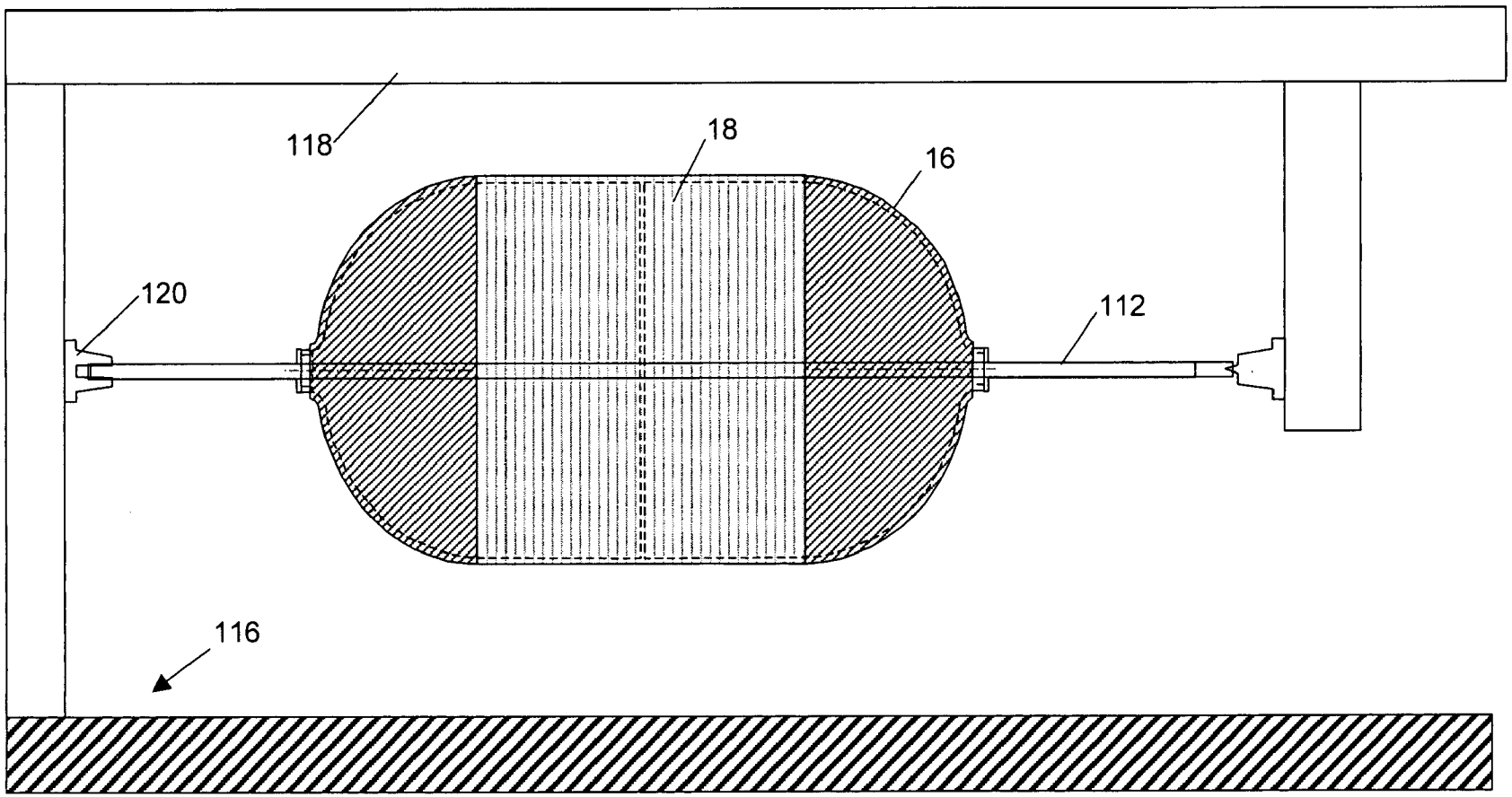
FIG. 19 is a diagrammatic view of the completed liner shell and its winding shaft mounted on a winding machine.

(11) Overwrapping of liner:

(a) Preparation: As shown in FIG. 18, a tank collar 110 is mounted on each of the bosses 80, and a bolt 112 is inserted through the collars, extending from each end of the liner shell 16. A locking bolt 114 secures the tank collar 110, and with it the liner shell 16, to the bolt 112 at one end thereof. This end is coupled to the drive side of a winding machine 116, as shown in FIG. 19. The machine 116 includes a rigid frame 118 and a driven three-jawed chuck 120 for gripping the bolt 112 and rotating the liner shell for the wrapping operation.

Figure 20:
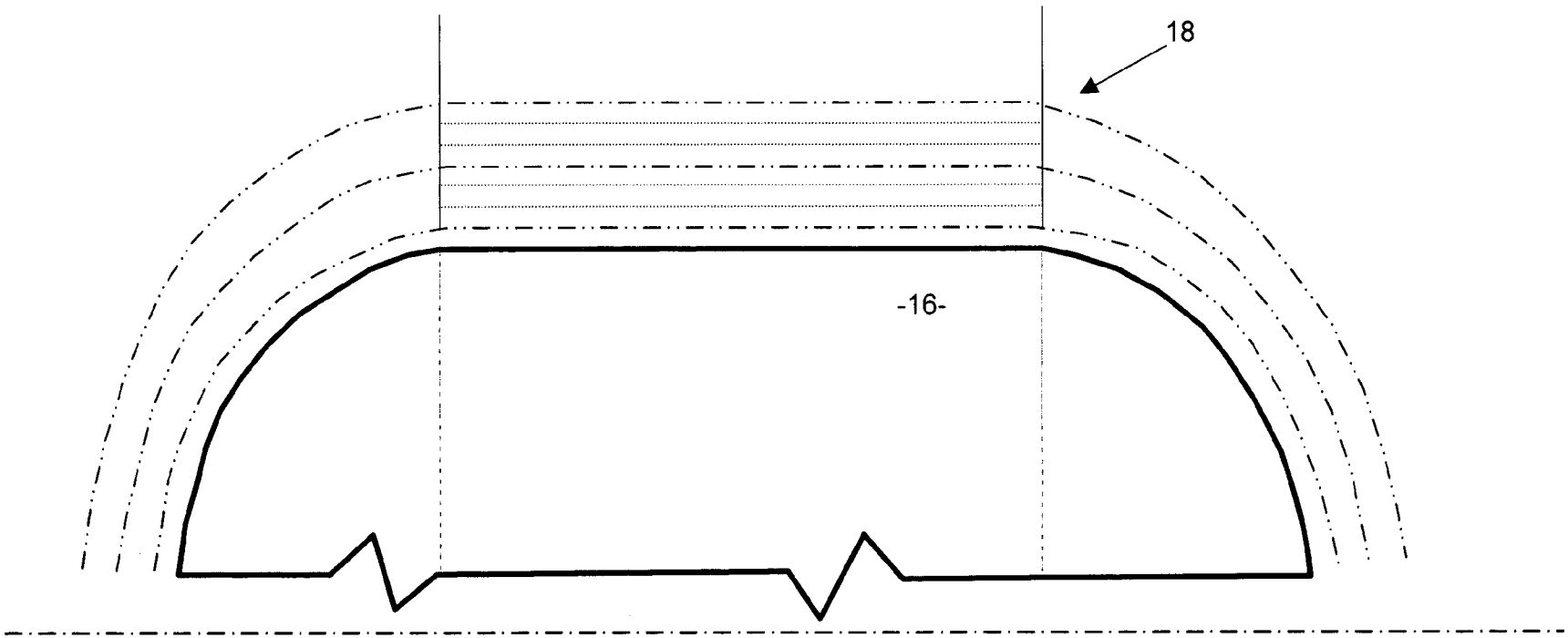
FIG. 20 is a diagrammatic cut showing the basic tank winding schedule for overwrapping the liner shell.

Basic Wrapping: As shown in FIG. 20, the liner shell 16 is a filament wound with additional layers of composite material to satisfy the desired strength and stiffness requirements of the vessel. The winding schedule shown by way of example includes three helical layers shown by the broken lines with dots and dashes (-.-.-.-.-.), and hoop or circular layers shown by dotted lines (.....). The helical layers are applied at an angle of 13.3° to the axis of the liner shell 16 and extend over the entire surface of the liner shell 16, including the cylindrical and domed portions. Each helical layer uses twenty-four tows of material simultaneously and makes ninety circuits of the liner shell 16. A first helical layer is followed by two of the hoop layers, extending only across the cylindrical portion of the liner shell 16. A second helical layer follows these, and then another two hoop layers are applied. A third helical layer follows, and then a final two circular layers. This configuration results in a dome thickness of a little more than half the thickness of the cylindrical portion, because the hoop layers cover the cylindrical portion only. Both the hoop and helical layers may, for example, use carbon tows such as 12K IM7, with twenty-four tows in each bandwidth.

Figure 21:
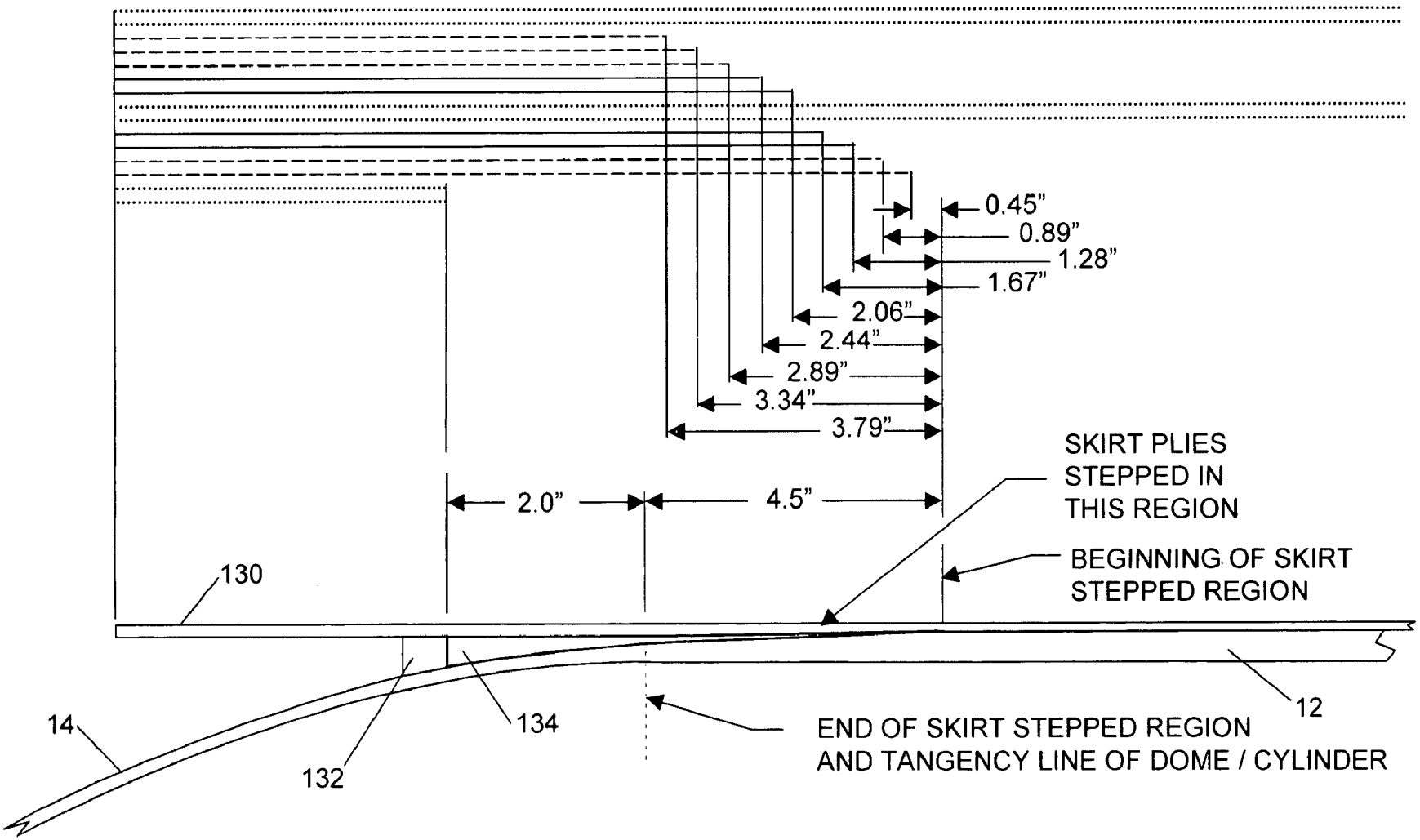
FIG. 21 is a diagrammatic cut showing the winding schedule and adhesive shear ply y-joint for the composite skirts on the pressure vessel.

(c) Skirt Lay-up: After the basic overwrapping described above an additional wrapping step is performed to fabricate a skirt 130 at the each end of the structure, as depicted in FIG. 21. Each skirt 130 is a continuation of the cylindrical body 12 of the tank 10 beyond the tangency line at which the cylindrical body 12 transitions into the end dome 14. The skirts 130 are used to support the tank 10 and also may be used as primary load carrying structural members. Therefore, the skirts 130 may support not only the weight of the tank and its contents, but as a primary structural member may react additional loading environments imposed on it during, for example, fabrication, shipping and handling, launch, and service life.

The skirts 130 are formed from laid-up plies of composite material, some of which are stepped to terminate near the tangency line between the dome 14 and the cylindrical body 12, and some of which extend from end to end of the two skirts. The layers wound to form the skirts are of three different types in the illustrate embodiment. First there are 90° degree hoop layers, such as 12K IM7 carbon tows, shown by the dotted lines. Then there are 0° unidirectional carbon layers, shown by the dashed lines, and finally there are carbon fabric layers, such as 282 Style Plainweave carbon, shown by the solid lines. The winding schedule calls for two hoop layers near the ends of the skirts 130, followed by two unidirectional carbon layers extending from the skirt ends to a point beyond the tangency line. These are followed by two carbon fabric layers, with each layer extending not as far as its predecessor beyond the tangency line, as shown in FIG. 21. Then two hoop layers are applied, extending the full length of the structure from one skirt end to the other. Next, the stepping continues with the application of two more carbon fabric layers and three additional unidirectional carbon layers, again with each successive layer extending not as far as its predecessor beyond the tangency line. Finally, two additional hoop layers are applied for the full length of the structure from one skirt end to the other. As an option, for example to save weight, the four hoop layers may be terminated a few inches beyond the end of the other layers and not extend the full length of the structure.

As depicted in FIG. 21, the junction between the tank 10 and the skirt 130 may be characterized as a Y-shaped joint, where the combined tank and skirt structures in the cylindrical region diverge apart to form the dome and the skirt. The skirt structure also includes an annular rubber dam 132 installed in the Y joint, between the skirt 130 and the outermost layer of the dome. The rubber dam 132 can be a custom-made or conventional O-ring chord. An annular space 134 in the Y joint, bounded by the tank dome, the skirt 130 and the rubber dam 132, is preferably filled with an appropriate adhesive prior to fabrication of the skirt. This construction is referred to as a shear ply. The shear ply, which is preferably cryogenically compliant, acts to prevent stress peaking at the shear joint between the skirt 130 and the body of the tank 10. A suitable two-part adhesive is Dexter Hysol EA9361.

(12) Conclusion:

It will be appreciated from the foregoing that the present invention represents a significant advance in techniques for fabricating pressure vessels used to contain cryogenic materials or for launch vehicle and other space applications. In particular, the invention is a departure from conventional metal lined pressure vessels. Because the pressure vessel of the invention includes a liner shell of composite material, which is overwrapped with additional composite layers to form the vessel structure, the vessel is lighter in weight and less costly than conventional vessels for the same purpose, and yet performs as well in harsh environments. The technique of the invention can be used to fabricate vessels for storage of cryogenic materials, rocket fuels, or other materials. It will also be appreciated that, although specific embodiments of the invention have been described in detail for purposes of illustration, various modifications may be made without departing from the spirit and scope of the invention. Accordingly, the invention should not be limited except as by the appended claims.

What is claimed is:

1. A pressure vessel for containing cryogenic or other materials, the vessel comprising:

a complete liner shell including at least two separate portions bonded together, each fabricated from composite material and cured out-of-autoclave; and an outer structure fabricated from composite material applied over an entire surface of the complete liner shell to complete the vessel;

wherein the at least two separate portions of the complete liner shell are filament wound composite material.

2. The pressure vessel as defined in claim 1, wherein the at least two separate portions comprise two separate halves of the complete liner shell.

3. A pressure vessel as defined in claim 1, wherein the at least two separate portions of the complete liner shell are bonded together with a splice band.

4. A pressure vessel as defined in claim 1, wherein the outer structure is a filament wound composite material.

5. A pressure vessel as defined in claim 1, wherein the composite material of the outer structure is out-of-autoclave.

6. A pressure vessel for containing cryogenic or other materials, the vessel comprising:

a complete liner shell including at least two separate portions bonded together, each fabricated from composite material and cured out-of-autoclave; and an outer structure fabricated from composite material applied over an entire surface of the complete liner shell to complete the vessel; wherein the vessel has a cylindrical body with domed ends;

the vessel further includes at least one boss fitting integrated into one of the domed ends to provide means for filling and evacuating the vessel; and the boss fitting is metal.

7. A pressure vessel for containing cryogenic or other materials, the vessel comprising:

a complete liner shell including at least two separate portions bonded together, each fabricated from composite material and cured out-of-autoclave; and an outer structure fabricated from composite material applied over an entire surface of the complete liner shell to complete the vessel; wherein the vessel has a cylindrical body with domed ends;

the vessel further includes at least one boss fitting integrated into one of the domed ends to provide means for filling and evacuating the vessel; and the vessel further comprises a composite skirt structure at each end of the vessel, extending cylindrically over a portion of each domed end.

8. The pressure vessel as defined in claim 7, wherein the vessel further includes a quantity of cryogenically compliant adhesive installed between the skirt structure and the domed ends of the vessel, to prevent stress peaking when the skirt is subject to loading.

9. A pressure vessel for containing cryogenic or other materials, the vessel comprising:

a complete liner shell including at least two separate portions bonded together, each fabricated from composite material and cured out-of-autoclave; and an outer structure fabricated from composite material applied over an entire surface of the complete liner shell to complete the vessel; wherein the vessel has a cylindrical body with domed ends;

the vessel further includes at least one boss fitting integrated into one of the domed ends to provide means for filling and evacuating the vessel; and the composite materials from which the complete liner shell and outer structure are formed include material selected from the group consisting of fiberglass fabric, graphite fabric, fiberglass fiber and graphite fiber.

10. A pressure vessel for containing cryogenic or other materials, the vessel comprising:

a complete liner shell including at least two separate portions bonded together, each fabricated from composite material and cured out-of-autoclave; and an outer structure fabricated from composite material applied over an entire surface of the complete liner shell to complete the vessel; wherein the vessel has a cylindrical body with domed ends;

the vessel further includes at least one boss fitting integrated into one of the domed ends to provide means for filling and evacuating the vessel; and the vessel further includes a layer of cryogenically compliant adhesive applied inside the complete liner shell of the vessel.

* * * * *